US009949520B2

(12) United States Patent
Terada

(10) Patent No.: US 9,949,520 B2
(45) Date of Patent: Apr. 24, 2018

(54) FOLDING HAT

(71) Applicant: CHUO BOHSHI CO., LTD., Osaka (JP)

(72) Inventor: Takao Terada, Osaka (JP)

(73) Assignee: CHUO BOHSHI CO., LTD., Osaka (JP)

( * ) Notice: Subject to any disclaimer, the term of this patent is extended or adjusted under 35 U.S.C. 154(b) by 9 days.

(21) Appl. No.: 14/169,905

(22) Filed: Jan. 31, 2014

(65) Prior Publication Data

US 2014/0331384 A1 Nov. 13, 2014

(30) Foreign Application Priority Data

May 9, 2013 (JP) ..... 2013-002560 U

(51) Int. Cl.
*A42B 1/20* (2006.01)

(52) U.S. Cl.
CPC ..... *A42B 1/201* (2013.01)

(58) Field of Classification Search
CPC .. A42B 1/02; A42B 1/06; A42B 1/062; A42B 1/063; A42B 1/18; A42B 1/20; A42B 1/201; A42B 1/206
USPC ..... 2/1, 175.1–175.5, 195.3–195.5, 2/209.11–209.13; 29/282; 63/3.1; 140/105, 106; 403/305
See application file for complete search history.

(56) References Cited

U.S. PATENT DOCUMENTS 518,793 A * 4/1894 Smith ..... E04C 5/165 15/145
1,407,341 A * 2/1922 Veeck ..... A46B 7/06 15/145
1,753,041 A * 4/1930 Bourdon ..... B60C 15/04 16/108
1,946,998 A * 2/1934 Armstrong ..... 2/209.11
2,074,035 A * 3/1937 Ward ..... 24/669
2,099,915 A * 11/1937 Weatherhead, Jr. ..... 285/256
2,149,468 A * 3/1939 Santise ..... 2/175.5
2,495,041 A * 1/1950 Weiss ..... 2/171.01
2,663,024 A * 12/1953 Cantor ..... 2/175.5
(Continued)

FOREIGN PATENT DOCUMENTS

FR 787503 A * 9/1935
GB 433835 A * 8/1935
(Continued)

OTHER PUBLICATIONS

English translation of JP 60127327 U via "Phoenix Translations" of Elgin, TX 78621. Translation performed Dec. 2014.*

*Primary Examiner* — Jameson Collier
(74) *Attorney, Agent, or Firm* — Thompson Hine LLP

(57) ABSTRACT

A folding hat that eliminates the risk of damaging the cloth by an elastic ring for a long life. The folding hat has the elastic ring sewn in an outer circumferential edge of a brim, and the elastic ring is formed by coupling both ends of a flat wire rod shaped by rolling spring steel round wire. Regarding the elastic ring, both ends of the flat wire rod are preferably coupled by: inserting both ends of the flat wire rod in both sides of a tubular metal stop, respectively; and crushing the metal stop. The metal stop has a pair of facing convex parts on which the tips of both ends of the flat wire rod can respectively abut at an inner center part that may be used.

4 Claims, 2 Drawing Sheets

(56) References Cited

U.S. PATENT DOCUMENTS

| | | | | | |
|---|---|---|---|---|---|
| 2,799,721 | A * | 7/1957 | Floyd, Jr. | B21F 15/06 | 174/84 C |
| 2,958,723 | A * | 11/1960 | Logan | H01R 4/20 | 174/84 C |
| 3,033,600 | A * | 5/1962 | Drysdale | B21F 15/06 | 174/94 R |
| 3,474,399 | A * | 10/1969 | Teagno | 439/879 | |
| 3,496,574 | A * | 2/1970 | Liverant | 2/175.4 | |
| 3,874,776 | A * | 4/1975 | Seron | 351/123 | |
| 4,077,068 | A * | 3/1978 | Anderson | 2/428 | |
| 4,096,590 | A * | 6/1978 | Keshock | 2/175.5 | |
| 4,797,509 | A * | 1/1989 | Cook | H01R 4/20 | 156/49 |
| 4,999,851 | A * | 3/1991 | Hall | 2/175.5 | |
| 5,657,490 | A * | 8/1997 | Edmark | 2/182.1 | |
| 5,797,145 | A * | 8/1998 | Levinson | 2/244 | |
| 5,857,219 | A * | 1/1999 | Edmark | 2/182.2 | |
| 5,915,533 | A * | 6/1999 | Halle | 2/175.5 | |
| 5,950,241 | A * | 9/1999 | Gomez | 2/172 | |
| 6,061,835 | A * | 5/2000 | Lien | 2/175.5 | |
| 6,101,632 | A * | 8/2000 | Veazey | 2/175.5 | |
| 6,216,277 | B1 * | 4/2001 | Cheng | 2/171.03 | |
| 6,256,794 | B1 * | 7/2001 | Erickson | 2/209.11 | |
| 6,260,208 | B1 * | 7/2001 | Wang | 2/209.11 | |
| 6,468,130 | B1 * | 10/2002 | Thakur | A41C 3/0028 | 450/41 |
| 6,721,961 | B2 * | 4/2004 | Park | 2/175.5 | |
| 6,783,016 | B2 * | 8/2004 | Wang | 220/9.2 | |
| 2006/0040541 | A1 * | 2/2006 | Vaughn | H01R 4/72 | 439/289 |
| 2012/0180193 | A1 * | 7/2012 | Curiel | 2/209.11 | |
| 2013/0239293 | A1 * | 9/2013 | Wu | 2/209.13 | |

FOREIGN PATENT DOCUMENTS

| | | | | |
|---|---|---|---|---|
| JP | 60-127327 | | 8/1985 | |
| JP | 04082906 | A * | 3/1992 | A42B 1/20 |

* cited by examiner

FOLDING HAT

This application claims priority to Japanese Utility Model Application No. 2013-2560, filed on May 9, 2013, the entire contents of which is incorporated by reference herein.

TECHNICAL FIELD

The present application relates to a folding hat, in which an outer edge of a brim is provided with a ring member having spring elasticity.

BACKGROUND

Japanese Unexamined Patent Application Publication No. JP 60-127327 Y (Patent document 1) discloses a folding hat in which an outer circumferential edge of a brim is provided with a hollow ring part (space part), a ring made of endless elastomeric thin wire, such as stainless steel being charged thereinto as a core. According to this document 1, when the hat is unfolded, the brim expands toward outside in a radial direction with the elasticity of the ring, so that the hat can be used as a sun visor and a rain visor, and, when the hat is not in use, three overlapped circles are formed by overlapping the brim on the inside by bringing right and left sides of the brim to twist it in the shape of a figure 8, so that the hat can be folded in a circle shape having one-third of a size at use. If a part of the circles is pulled outside or the like, the hat can be instantly restored from the folded state to the developed state (use state) by the elasticity of the ring.

The hat of Patent document 1 has the brim comprised of an extremely flexible material so as to easily fold up. In contrast, the ring made of elastomeric thin wire has a vertically long rectangular cross-section and angular edges. Therefore, in the case of the hat of Patent document 1, there is a greater risk that friction with the edges of the ring may cause damage to the hollow part of the brim outer periphery through repeated folding and unfolding. Because constant tension is always applied to the space part by the elasticity of the ring, a damaged slit may easily become large immediately when the cloth is torn a little. Particularly, if the ring is made of stainless steel and thin, the edges become sharp like a knife, so the cloth is easily damaged and there is the risk of wounding the user.

The present invention has been made to solve the above-mentioned problems and aims to provide a folding hat which eliminates the risk of damaging the cloth by an elastic ring and which can be safely used for a long period of time.

SUMMARY

To achieve the above-mentioned purpose, in the present invention, there is provided a folding hat where an elastic ring is sewn in an outer circumferential edge of a brim, and the elastic ring is formed by coupling both ends of a flat wire rod with a vertically long cross section shaped by rolling spring steel round wire.

By rolling the round wire comprised of spring steel, the cross section of the flat wire rod becomes an ellipse, an oval, or a rectangle with rounded corners. Thus, the elastic ring of the present invention does not have any angular corners so that there is no risk of damaging cloth and fingers. Further, because spring steel is used as a material of the elastic ring, resiliency is kept for a long period of time. Because the elastic ring is sewn in the state of having vertically long cross section, the hat can be folded in a circle shape having one-third of a size as in the conventional techniques.

Although the spring steel may be any steel wire having elasticity, preferably stainless steel wire is adopted. This is because, for example, when a water proofing property is given to the cloth to facilitate use of the hat as a rain outfit, the elastic ring will resist rusting even if it gets wet with rain, and corrosion of the cloth caused by rust can be prevented. The term "spring steel" used in the present invention is not limited to "spring steel products" defined by JIS (Japan Industrial Standard), and "spring steel" widely refers to steel products having spring elasticity.

The elastic ring is formed in a ring shape by coupling both ends of the flat wire rod, and the coupling preferably comprises: inserting both ends of the flat wire rod in both sides of a tubular metal stop, respectively; and crushing a part corresponding to an inner peripheral side of the elastic ring of the metal stop to couple both ends of the flat wire rod. Although both ends of the flat wire rod may be directly coupled by welding and caulking, a ring shape must be kept against elasticity during operation in such a method, and maintaining this ring shape during welding/caulking takes a lot of effort. Moreover, because overlapping both ends of the flat wire rod would increase the thickness of a part where the ends overlap and form steps in the ring, the part becomes a sharp part by which the cloth might be damaged. In contrast, according to the coupling method using the metal stop, there is no such inconvenience, and furthermore, both ends of the flat wire rod are contained in the metal stop even if they are in a rough-cut state. Moreover, because the part where the metal stop is crushed corresponds to the inner peripheral side of the elastic ring, the crushed part does not contact with sewn-in part cloth of brim. As described above, according to the coupling method using the metal stop, the elastic ring does not have any sharp parts, so that there is no risk of damaging the cloth and fingers. According to the coupling method, as a result of tests by the inventor, very high fixing force was achieved.

Furthermore, since the metal stop has, at an inner center part, a pair of facing convex parts on which the tips of the both ends of the flat wire rod can respectively abut, both ends of the flat wire rod can be inserted into the metal stop at the same length. Therefore, both the right and left sides of the convex part of the metal stop can be crushed in this state in order to prevent the both ends of the flat wire rod from slipping off with equal force.

According to the present invention, since the elastic ring is configured with the flat wire rod having the vertically long cross section shaped by rolling spring steel round wire, there can be provided a folding hat with no angular corners and sharp parts, such that a sewn-in part of brim may not be damaged even if the hat is folded repeatedly, being superior in durability and being safe for a user.

In one aspect, a folding hat is disclosed, the folding hat including a brim and an elastic ring sewn in an outer circumferential edge of the brim. The elastic ring is formed by coupling both ends of a flat wire rod with a vertically long cross section shaped by rolling spring steel round wire.

Other aspects of the disclosed structure and method will become apparent from the following description, the accompanying drawings, and the appended claims.

DETAILED DESCRIPTION

Figure 1:
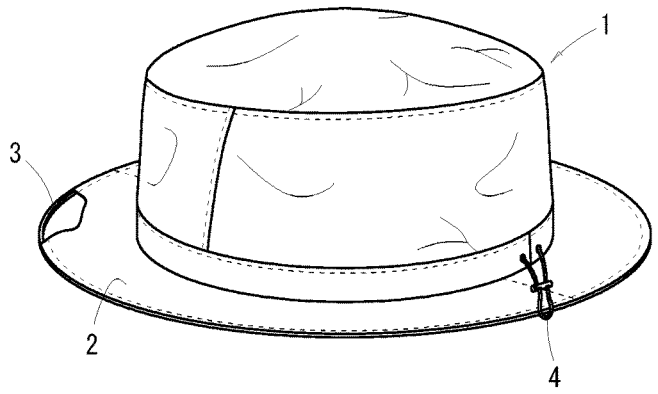
FIG. 1 is a complete perspective view of the folding hat according to one embodiment of the present invention, where a part of the brim is cut out.

The following detailed description will illustrate the general principles of the invention, examples of which are additionally illustrated in the accompanying drawings. In the drawings, like reference numbers indicate identical or functionally similar elements.

The preferred embodiment of the present invention is described below in accordance with the attached drawings. FIG. 1 is an overall perspective view of the folding hat according to one embodiment of the present invention. The folding hat includes a crown 1, a brim 2 and an elastic ring 3 sewn in an outer circumferential edge of the brim 2. A tightening strap 4, such as a rubber strap, is provided on the crown 1 to adjust the circumference of head.

Figure 2:
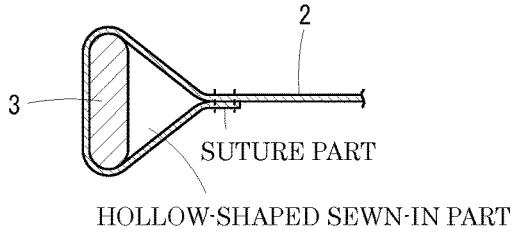
FIG. 2 is an enlarged cross-sectional view of a part in which the elastic ring is sewn.

Elastic ring 3 is formed by rolling round wire comprised of spring steel, such as stainless steel (SUS304), with a roller to obtain a flat wire rod and by then coupling both ends of the flat wire rod. For example, in the embodiment as shown in FIG. 3A, a round wire with a diameter of 1.4 mm is made to be a vertically long elliptical cross-section shape (also referred to a shape of "oval coin" in Japan) formed by rolling, with a thickness of 0.6 mm and a vertical width of 2.1 mm. Elastic ring 3 with such a cross-sectional shape, as shown in FIG. 2, is sewn in the outer circumferential edge of the brim 2, for example by housing the ring in a hollow-shaped sewn-in part formed by the upper cloth and lower cloth. Since the ring has entirely no angular corner, the sewn-in part cloth of the brim 2 is not damaged. Also, fingers are not injured.

Figure 3:
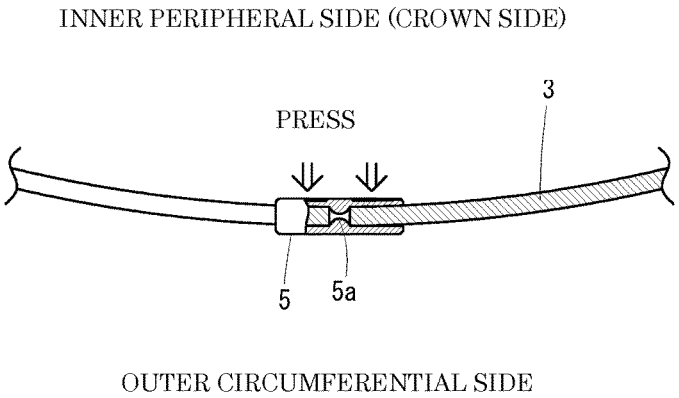
FIG. 3 is an enlarged cross-sectional view of a coupling part of the elastic ring.
Figure 3A:
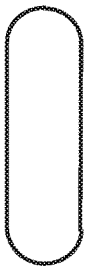
FIG. 3A is a cross-section of the elastic ring shown in FIG. 3.

The elastic ring is previously formed in a ring shape by coupling both ends of the flat wire rod before being sewn in the brim 2 and therefore, in this embodiment, a metal stop 5 is used as a coupling means as shown in FIG. 3. The metal stop 5 is a metal tube comprised of copper or the like and, after respectively inserting the both ends of the flat wire rod in both sides of the metal tube, both ends of the wire rod can be coupled by flatly crushing the tube with a caulking machine or the like. The metal stop 5 is preferably coated with tin or the like to prevent corrosion, but is not limited to that.

As a more preferable configuration, the metal stop 5 in this embodiment has a pair of facing convex parts 5*a* on which the tips of both ends of the flat wire rod abut at an inner center part of the metal stop 5. Therefore, the flat wire rod is inserted in the metal stop 5 until it abuts on the convex parts 5*a*, so that the insertion length of the both ends can be made to be the same. Although a pair of facing convex parts 5*a* is confronted on the inside and outside of the ring in FIG. 3, the convex part may be prepared on either of the sides or it may be formed in a blind wall to separate the inside of the metal stop 5 into right and left.

After the insertion, the metal stop 5 is flatly crushed to keep both ends of the flat wire rod in a retention state as described above. Since the part crushed flatly inevitability has some angular corners, the cloth might be damaged. Thus, in this embodiment, only one side corresponding to an inner peripheral side of the elastic ring is flatly crushed. For example, when the metal stop 5 is sandwiched and flatly crushed, only one side on an inner peripheral side of the metal stop 5 can be crushed as described above by treating a member with the same inner shape as an outer shape of the stop 5 as a base to use an apparatus which moves a beaten piece towards this base within a predetermined range. According to the coupling method, since the flatly crushed part of the metal stop 5 is located on the inner peripheral side of the elastic ring, it does not contact with the cloth when the ring is sewn in the brim 2, so that there is no risk of damaging the cloth.

In this embodiment, furthermore, since both of the pair of facing convex parts 5*a* are flatly crushed with the same force at one moment in flatly crushing the metal stop 5, a coupling operation of the flat wire rod is completed by single press. Constant-Rate-of-Extension Type Tensile Test was performed on the elastic ring coupled with the metal stop 5 to measure drawing strength from the metal stop 5. As a result, the maximum load just after the press working was 75.0 N. Further, the same test was performed on a product in which the elastic ring had been sewn after having folded it 1,000 times over at a rate of approximately ten times/m. As a result, very high drawing strength of the maximum load 52.0 N was shown.

Figure 4:
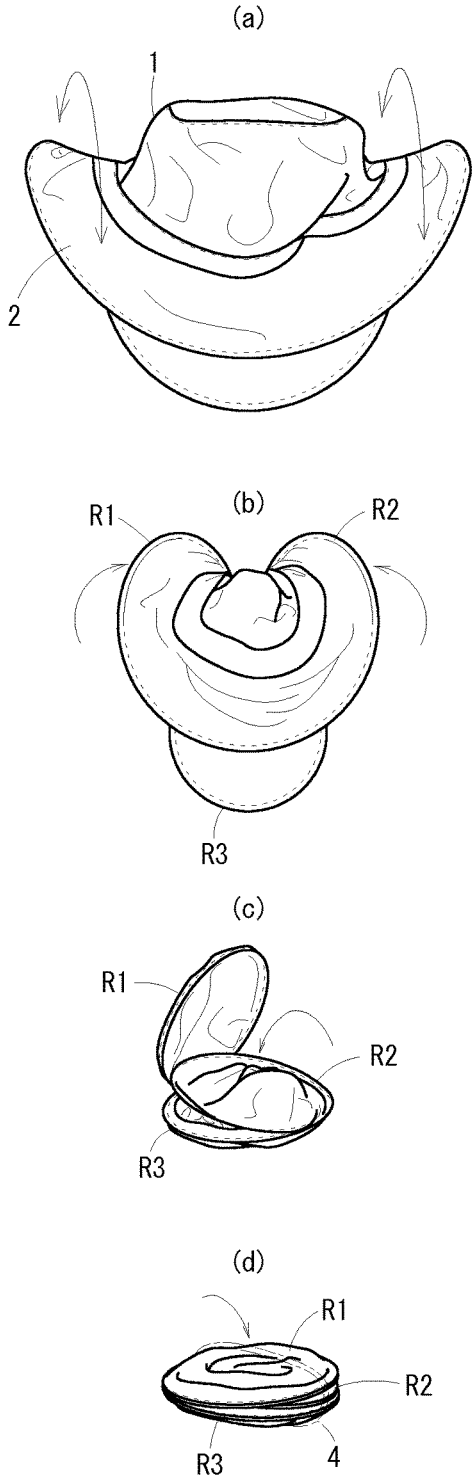
FIG. 4 is an explanatory drawing of a folding method.

In the present invention, the hat can be also folded in a circle shape having one-third of a size as in the conventional techniques. Although the folding method cannot be defined unambiguously, for example, in the method shown in FIG. 4, first, the hat is folded about to the half (FIG. 4 (*a*)), next, three small circles R1-R3 are formed right, left and below by drawing bilateral curved parts inward (FIG. 4 (*b*)), then, one of the bilateral circles R2 is folded overlapped on the below circle R3 (FIG. 4 (*c*)) and finally, the last circle R1 is overlapped, so that the hat can be folded in a circle shape having one-third of a size from FIG. 1 (FIG. 4 (*d*)). Further, when slight outward force is applied to either of the small circles in the folded state by elasticity of elastic ring 3, the hat is instantly restored to the use state (unfolded state) shown in FIG. 1. In order to prevent careless extension, it is preferable to accommodate the hat in a pouch or the like, but, in the present embodiment, the extension can be temporarily prevented until the hat is contained in the pouch or the like by winding a tightening strap 4 for adjustment provided on the crown 1 about the center of the folded one-third circular ring.

The cloth of the crown 1 and the brim 2 requires flexibility without hindering folding, but it is not particularly limited. Regarding the brim 2, shape retainability is obtained by the elastic ring when the hat is used, so that there is no problem even if thin cloth is used. Moreover, depending on the application, waterproofing, UV protection processing and the like are freely applied to the cloth.

The shape of the brim 2 is not limited to the shape which forms a perfect circle in the use state as shown in FIG. 1, and it may be an ellipse. Moreover, right and left of the brim 2 may be curved upward to shape in a ten-gallon hat-style and a cowboy hat-style by making width of the upper cloth slightly smaller than the lower cloth, etc.

The embodiments of this invention shown in the drawings and described above are exemplary of numerous embodiments that may be made within the scope of the appended claims. It is contemplated that numerous other configurations of the containment system may be created taking advantage of the disclosed approach. In short, it is the applicant's intention that the scope of the patent issuing herefrom be limited only by the scope of the appended claims.

What is claimed is:

1. A folding hat comprising:

a crown;

a brim;

an elastic spring steel ring having a vertically long rectangle with rounded corners shape in cross-section, wherein the spring steel ring is sewn in an outer circumferential edge of the brim, the ring having first and second opposing ends, the opposing ends each defining a respective tip, the ring not having any angular corners along an entire length of the ring between the tips;

a tubular metal stop having a pair of sides, a pair of facing convex parts, an inner peripheral side facing the crown, and an inner center part, wherein the first opposing end of the flat wire rod is received by one of the sides of the pair of sides and the second opposing end of the flat wire rod is received by a remaining side of the pair of sides, and a portion of the tubular metal stop at the inner peripheral side is flat to couple both of the first and second opposing ends of the flat wire rod to form the spring steel ring; and wherein the tips of both of the first and second opposing ends of the flat wire rod are spaced apart from each other within the tubular metal stop, and the tips each abut the facing convex parts at the inner center part of the tubular metal stop.

2. The folding hat according to claim 1, wherein the spring steel is stainless steel.

3. A folding hat comprising:

a crown;

a brim comprising cloth;

an elastic ring sewn in an outer circumferential edge of the brim, wherein the elastic ring comprises a flat wire rod with a cross section that is vertically long relative to a width thereof;

a tubular metal stop having a pair of sides and an inner peripheral side facing the crown, wherein the flat wire rod has first and second opposing ends that each define a respective tip, wherein the first opposing end of the flat wire rod is received in one of the pair of sides of the tubular metal stop and the second opposing end of the flat wire rod is received in a remaining one of the pair of sides, and wherein the tubular metal stop is flat only at the inner peripheral side to retain and couple both the first and second ends of the flat wire rod in a spaced-apart relation from each other within the tubular metal stop to define the elastic ring, such that the flat inner peripheral side of the tubular metal stop does not contact a sewn-in part of the cloth of the brim; and wherein the cross section of the flat wire rod lacks angular corners along an entire length of the flat wire rod between the tips.

4. The folding hat of claim 3, wherein the tubular metal stop has a pair of facing convex parts wherein the tips of both of the first and second ends of the flat wire rod respectively abut the facing convex parts at an inner center part of the metal stop.

* * * * *